US005842362A

United States Patent [19]

DePonty et al.

[11] Patent Number: 5,842,362

[45] Date of Patent: Dec. 1, 1998

[54] KEY MANAGEMENT DEVICE, AND METHODS OF CONSTRUCTING AND UTILIZING SAME

[76] Inventors: Ernest DePonty, W. 2628 Providence, Spokane, Wash. 99205; David Sherwin, 2301 N. Wilbur Rd., Apt. 68, Spokane, Wash. 99206

[21] Appl. No.: 901,092

[22] Filed: Jul. 28, 1997

[51] Int. Cl.[6] ..... E05B 11/00

[52] U.S. Cl. ..... 70/389; 70/456 R; 70/388

[58] Field of Search ..... 70/389, 456 R, 70/61, 429, 430, 441, 432, 63, 388; 211/9

[56] References Cited

U.S. PATENT DOCUMENTS

| | | | |
|---|---|---|---|
| 2,220,786 | 11/1940 | Grainger | 70/61 |
| 2,336,936 | 12/1943 | Johnson | 70/61 |
| 4,472,952 | 9/1984 | Hollowell, Jr. | 70/389 |
| 4,631,358 | 12/1986 | Newcome . | |
| 4,641,509 | 2/1987 | Batchelor et al. | 70/389 |
| 4,661,806 | 4/1987 | Peters . | |
| 4,753,092 | 6/1988 | Mercer | 70/389 |
| 5,020,347 | 6/1991 | Logan | 70/389 |
| 5,372,021 | 12/1994 | Smith | 70/389 |
| 5,505,066 | 4/1996 | Baucom . | |

FOREIGN PATENT DOCUMENTS

| | | | |
|---|---|---|---|
| 477618 | 10/1969 | Switzerland | 70/389 |

*Primary Examiner*—Darnell M. Boucher

*Attorney, Agent, or Firm*—Carrier, Blackman & Associates, P.C.; Joseph P. Carrier; William D. Blackman

[57] ABSTRACT

A key management device, comprising a housing member; an access key; a mechanism for locking a key ring to the housing member and releasing the access key when the locking mechanism is in a first position, and for locking the access key to the housing member and releasing the key ring when the locking mechanism is in a second position; wherein the locking mechanism comprises a first member which is movable between the first position in which the key ring is locked to the housing by the first member and the second position in which the key ring is unlocked therefrom, and a second member which is connected to the first member, wherein when the locking mechanism is in the first position the second member releases the access key from the housing member and when the first member is in the second position the second member locks the access key to the housing; and wherein the access key is slidingly received by the housing member and engages with the first member such that insertion of the access key within the housing moves the locking mechanism from the second position to the first position.

20 Claims, 3 Drawing Sheets

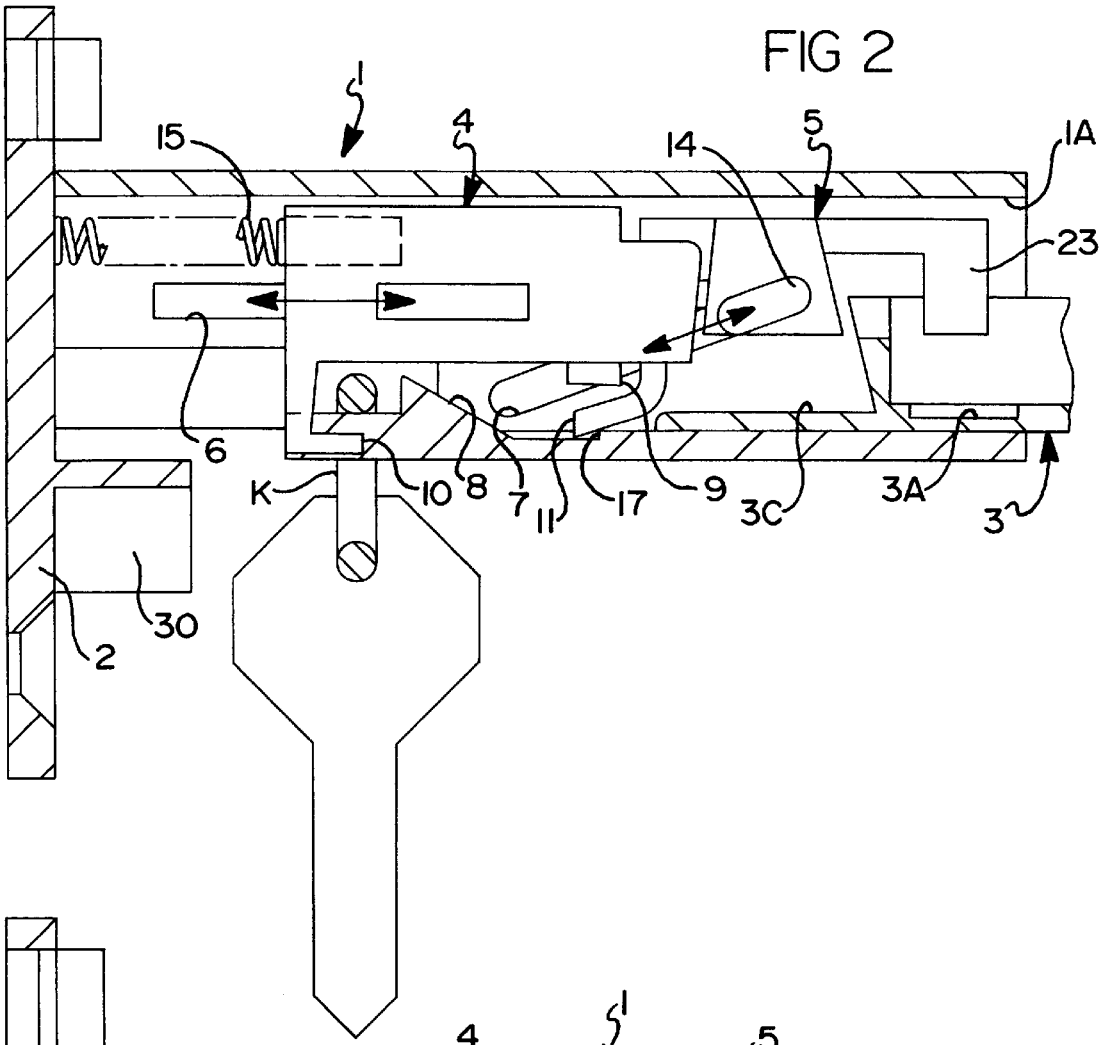
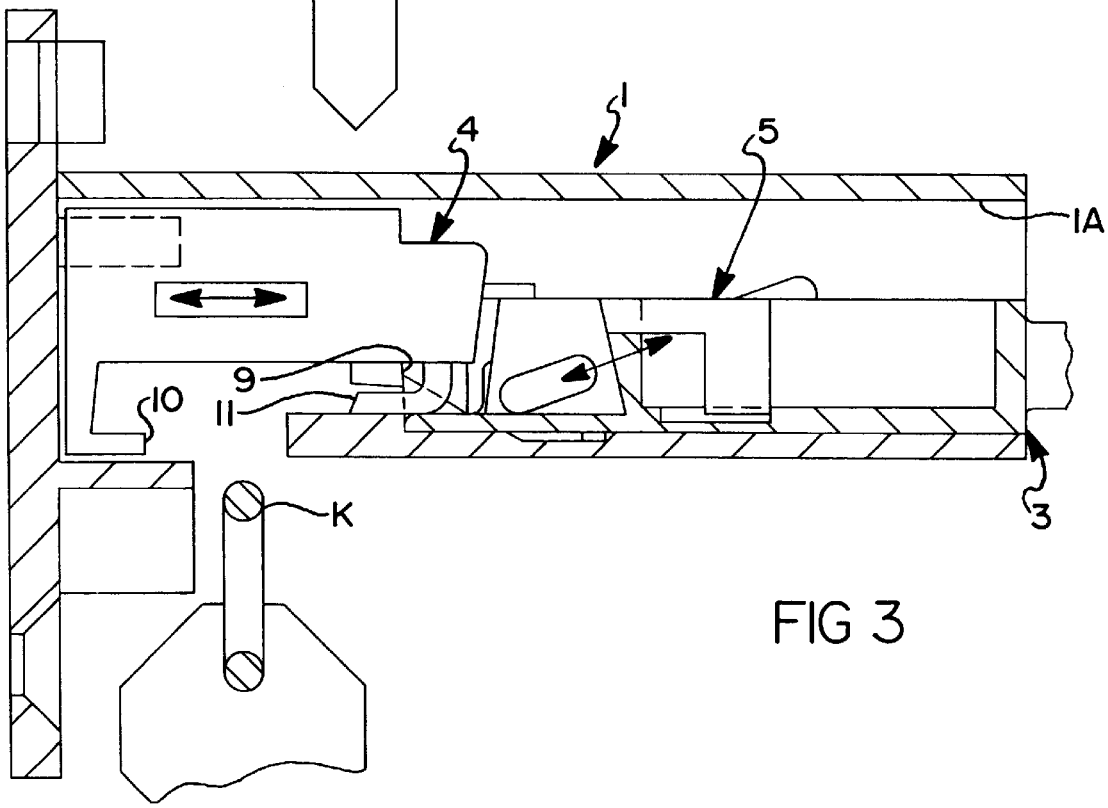
FIG 3

FIG 4
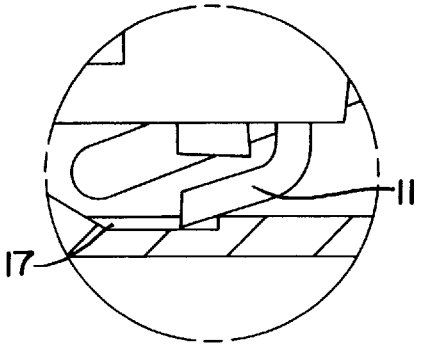
FIG 5
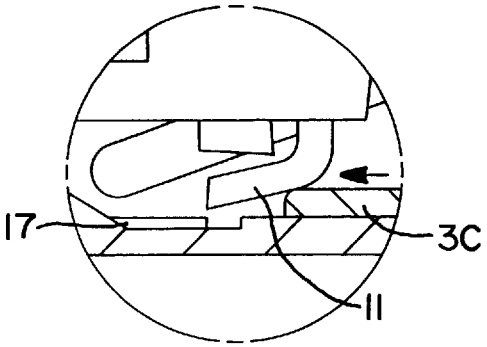
FIG 6
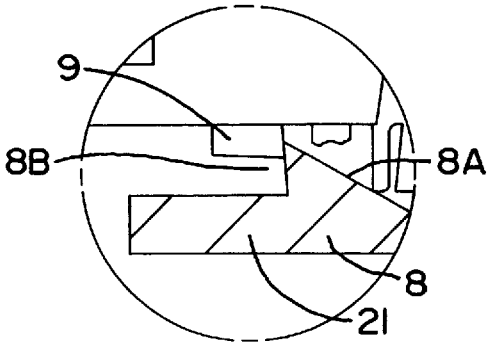
FIG 7
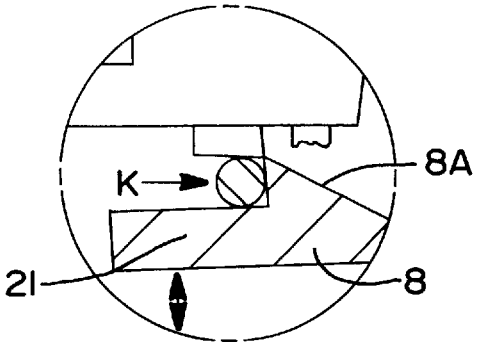
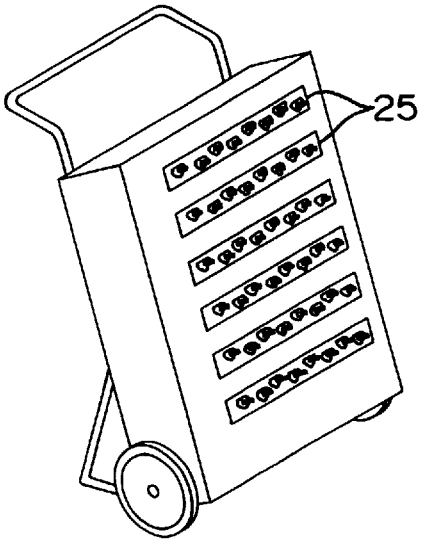
FIG 8
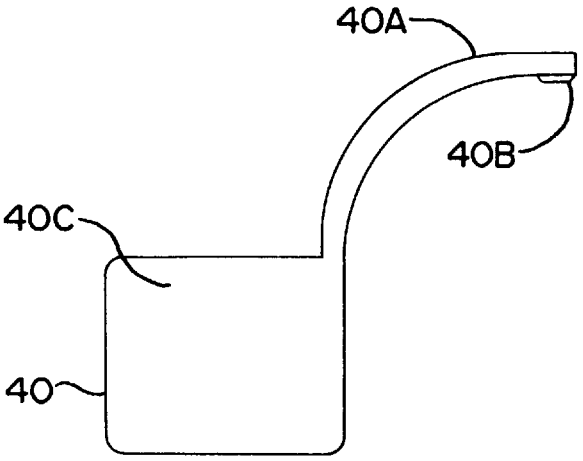
FIG 9

KEY MANAGEMENT DEVICE, AND METHODS OF CONSTRUCTING AND UTILIZING SAME

BACKGROUND OF THE INVENTION

1. Field of Invention

This invention relates to a device for managing one or more sets of keys, and particularly to a device for controlling access to keys and recording key access.

2. Description of the Relevant Art

There are known devices for managing keys. For instance, Hollowell U.S. Pat. No. 4,472,952 discloses a retaining station to which an article is normally locked and an access key which unlocks the article from the retaining station.

Newcome U.S. Pat. No. 4,631,358 discloses an electronic device for article storage and release.

Batchelor U.S. Pat. No. 4,641,509 discloses a panel on which a pattern of slots and key retaining mechanisms are disposed.

Peters U.S. Pat. No 4,661,806 discloses an electronically controlled key rack.

Mercer U.S. Pat. No. 4,753,092 discloses a panel on which is disposed a plurality of box-like containers and key locks for selectively opening the containers.

Smith U.S. Pat. No. 5,372,021 discloses a primary key slot and a secondary key slot, and a means for retaining a key in the primary key slot while releasing a key from the secondary key slot and for retaining a key in the secondary key slot while releasing a key from the primary key slot.

Baucom U.S. Pat. No. 5,505,066 discloses a key safe apparatus comprising a plurality of key receptacle pairs, a pair of keys, and a means for releasing one key of the key pair while retaining the second key thereof.

The above-identified patents, however, disclose systems which are relatively complex and cost prohibitive, and which include conventional access keys which can be relatively easily replicated, thereby presenting security problems.

SUMMARY OF THE INVENTION

The present invention overcomes the above-discussed limitations and shortcomings of known key management devices and satisfies a significant need for a device which effectively limits access to one or more key rings both securely and economically.

According to the present invention, there is provided a key management device comprising a housing member; an access key; a means for locking a key ring to the housing member and releasing the access key when the locking means is in a first position, and for locking the access key to the housing member and releasing the key ring when the locking means is in a second position; wherein the locking means comprises a first member which is movable between the first position in which the key ring is locked to the housing member by the first member and the second position in which the key ring is unlocked therefrom, and a second member which is connected to the first member, wherein when the locking means is in the first position the second member releases the access key from the housing and when the first member is in the second position the second member locks the access key to the housing; and wherein the access key is slidingly received by the housing member and engages with the first member such that insertion of the access key within the housing member moves the locking means from the second position towards the first position.

A preferred embodiment of the present invention includes a backplane on which a plurality of housing members are mounted; a locking means associated with each housing member; and a plurality of identical access keys, each of which is operable with each locking means. In this way, the present invention may be utilized to manage a plurality of key rings.

In use, one or more key rings are stored on the housing members on the backplane in a locked position and an access key is provided to each individual needing access to any or all of the key rings. To gain access to a key ring, an access key holder slides his access key into the housing member holding the desired key ring, which causes the first member and the second member to translate from the first position until the first member is locked into the second position. As the first member is locked into the second position, the second member locks the access key to the housing member. In the second position, the corresponding key ring may be removed from the housing member.

Returning the removed key ring to the backplane in order to be retained thereby includes the steps of unlocking the first member from the second position by urging a resiliently biased portion of the housing member downwardly, which causes the first member and the second member to translate, until the first member is locked into the first position. Translation of the second member towards the first position releases its locked engagement with the access key, so that the access key may be manually withdrawn from the housing member.

It is an object of the present invention to provide a device for controlling the accessibility of one or more sets of keys.

Another object of the present invention is to provide such a device which is simple in construction and inexpensive to manufacture.

It is another object of the present invention to provide a key management device having access keys which are difficult to duplicate.

Another object of the present invention is to provide a key management device that is easily expandable to accommodate virtually any application.

Still another object of the present invention is to provide a key management device that is portable.

It is another object of the present invention to quickly and easily record the individual who accessed a key from the present invention.

Other objects, advantages, and salient features of the present invention will become apparent from the following detailed description, which, when taken in conjunction with the annexed drawings, discloses preferred embodiments of the present invention.

BRIEF DESCRIPTION OF THE DRAWINGS

FIG. 2 is a cross-sectional view of a preferred embodiment of the present invention retaining a key ring.

FIG. 3 is a cross-sectional view of a preferred embodiment of the present invention releasing a key ring.

FIG. 4 is a side elevational view of a first locking mechanism according to a preferred embodiment of the present invention.

FIG. 5 is a side elevational view of a first locking mechanism according to a preferred embodiment of the present invention.

FIG. 6 is a side elevational view of a second locking mechanism according to a preferred embodiment of the present invention.

FIG. 7 is a side elevational view of a second locking mechanism according to a preferred embodiment of the present invention.

FIG. 8 is a perspective view of a second preferred embodiment of the present invention.

FIG. 9 is a side elevational view of a master key according to a preferred embodiment of the present invention.

DETAILED DESCRIPTION OF THE PREFERRED EMBODIMENTS

Figure 1:
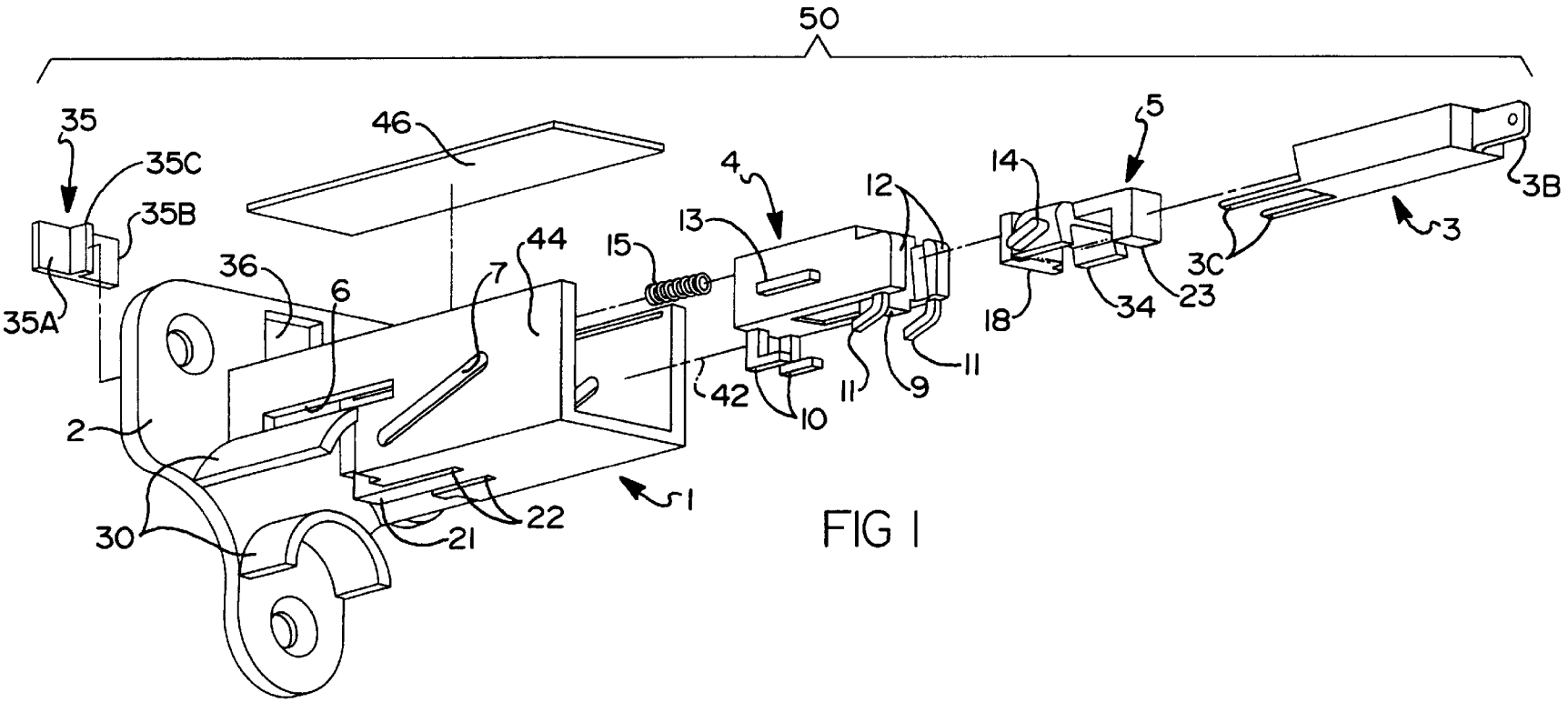
FIG. 1 is an exploded perspective view of a preferred embodiment of the present invention.

Referring to FIGS. 1–7, there is shown a key management device 50 according to a first preferred embodiment of the present invention, including at least one housing member 1 from which a key ring K may be suspended, at least one mounting plate 2 to which a housing member 1 is attached, a plurality of access keys 3, each of which is individually operably received by each housing member 1, and a locking means for retaining an access key 3 in a housing member 1 while releasing a key ring K therefrom, and for releasing the retained access key 3 from housing member 1 while retaining the key ring K thereby.

Housing member 1 is adapted to retain a key ring K, contain the locking means, protect against tampering and operably receive an access key 3. As shown in FIG. 1, housing member 1 is elongated having a substantially rectangular cross-section. The housing member 1 has a longitudinal axis 42 (FIG. 1) and includes a hollow base 44, having a generally trough-like shape, and a cover plate 46 which fits over the base 42. Housing member 1 is preferably mounted along mounting plate 2 so as to extend outwardly therefrom. The outwardly extending end of housing member 1 is preferably substantially open in order to define a channel 1A into which an access key 3 may be received.

Housing member 1 and mounting plate 2 are preferably constructed from a sturdy and rigid material, such as a metal composite. Alternatively, housing member 1 and mounting plate 2 are constructed from other material.

The locking means is preferably moveable between a first state and/or position in which a key ring K is retained by housing member 1 and an access key 3 is released therefrom (FIG. 2), and a second state and/or position in which the key ring K is released from housing member 1 and an access key 3 is retained thereby (FIG. 3).

According to a preferred embodiment of the present invention, the locking means comprises first member 4 and second member 5, both of which are slidingly engaged within housing member 1. Referring to FIGS. 1–4, first member 4 is disposed in the section of housing member 1 nearest mounting plate 2 and slides in an axial direction as guided by slots 6 defined along either side of housing member 1. Tabs 13 preferably extend from either side of first member 4 and are shaped to substantially fit within slots 6 of housing member 1 so that first member 4 is slidable in a substantially horizontal direction.

Similarly, second member 5 is disposed in the section of housing member 1 substantially forwardly of first member 4 and slides in an axial direction as guided by slots 7 defined along either side of housing member 1, as shown in FIG. 1. Tabs 14 preferably extend from either side of second member 5 and are shaped to substantially fit within slots 7 of housing member 1 so that second member 5 is slidable in an axial direction that is offset from the horizontal.

First member 4 and second member 5 are preferably connected to each other so that movement of first member 4 induces movement of second member 5. In this regard, first member 4 preferably includes a track defined by a pair of substantially L-shaped rails 12 (FIG. 1) that are disposed along an end of first member 4, and second member 5 preferably includes section 18 having a shape which conforms with the shape of the track of first member 1 so that section 18 of second member 5 is slidingly engaged with the track of first member 1 defined by rails 12.

The sliding engagement between first member 4, second member 5 and housing member 1 allows first member 4 to translate in a substantially horizontal direction as guided by slots 6 while second member 5 translates along a diagonal axis as guided by slots 7. Specifically, the sliding relationship allows second member 5 to translate both horizontally and vertically in response to horizontal movement by first member 4. As second member 5 translates between its uppermost position within housing member 1 (FIG. 2) and its lowermost position therewithin (FIG. 3), section 18 of second member 5 slides between the upper and lower portions of the track of first member 4, respectively.

The locking means according to a preferred embodiment of the present invention preferably further includes first member 4 having substantially L-shaped flanges 10 which extend downwardly from a lower end thereof, as shown in FIG. 1. Flanges 10 secure a key ring K against housing member 1 when the locking means is in the first position, as shown in FIG. 2. When the locking means is in the first position, flanges 10 are disposed along either side of tab member 21 of housing member 1 so that a key ring K cannot be removed. Flanges 10 preferably extend sufficiently downwardly so that conventionally sized key rings may be suspended therefrom.

The locking means preferably includes a means for substantially locking first member 4 in the first position so that flanges 10 and housing member 1 retain a key ring K in a locked position, relative to housing member 1. The first position locking means preferably comprises a pay of flexibly resilient offset prongs 11 which extend downwardly from an end portion of first member 4, and detents 17 which extend upwardly from a lower, inner surface of housing member 1. The offset prongs 11 are preferably angled having the outer ends thereof being resiliently upwardly displaceable from a position at rest. Detents 17 are preferably disposed within housing member 1 so that each detent 17 is engageable with an outer end of a prong 11, thereby preventing first member 4 from axial movement when first member 4 is in the first position, as shown in FIG. 4. Release of the locked engagement between first member 4 and housing member 1 is accomplished by temporarily urging the outer ends of prongs 11 upwardly towards the main body of first member 4 until the ends disengage from detents 17, thereby making first member 4 axially slidable within housing member 1 (FIG. 5). In this way, first member 4 may be selectively locked into a position which retains a key ring K in a suspended, locked position relative to housing member 1.

Each access key 3 is preferably but not necessarily elongated, having a cross sectional shape which substantially conforms to channel 1A defined within the outer end portion of housing member 1 so that each access key 3 may be slidingly received thereby (FIG. 1). Each access key 3 preferably further includes a concave portion 3A which is defined in a central portion thereof. Concave portion 3A preferably has an opening along a surface of access key 3 which is adjacent second member 5 when access key 3 is inserted housing member 1. The dimensions of concave portion 3A preferably is such that a portion of second member 5 may be stably inserted therein.

Each access key 3 is preferably but not necessarily visually distinguishable from the other access keys 3, such as by color, so that when an access key 3 is retained by a housing member 1, the holder of the access key 3 may be quickly identified.

Each access key 3 preferably includes a handle portion 3B which is suitably shaped so that the access key holder may easily grip and maneuver access key 3. Each access key 3 preferably further includes a pair of horizontally oriented release prongs 3C (FIG. 1) which extend outwardly from the end of access key 3 which is opposite handle portion 3B. The release prongs 3C are preferably suitably sized and dimensioned for disengaging the offset prongs 11 of first member 4 from detents 17 in housing member 1 when access key 3 is sufficiently inserted therein, as shown in FIG. 5. In this way, an access key 3 may release the locked engagement of a key ring K from housing member 1.

First member 4 is preferably translatable between the first position in which a key ring K is locked against housing member 1 (FIG. 2), and the second position in which key ring K is released from its locked engagement with housing member 1 (FIG. 3), by inserting an access key 3 into housing member 1, while the inserted access key 3 is retained thereby. The inserted access key 3 is preferably retained until the released key ring K is returned to and retained by housing member 1. This feature restricts access to key rings K by an access key holder to one key ring K at a time.

Accordingly, the locking means preferably comprises second member 5 having flange 23 which extends in a downward direction relative to housing member 1. Flange 23 is preferably spaced apart from ribs 34 of second member 5 (FIG. 1) and is adapted for insertion into concave portion 3A of access key 3 as second member 5 moves from the first position in which a key ring K is locked against housing member 1 and second member 5 is positioned along an upper portion of slots 7 (FIG. 2), to the second position in which key ring K is released from its locked engagement and second member 5 is positioned along a lower portion of slots 7 (FIG. 3). When the locking means, including second member 5, is in the second position, flange 23 of second member 5 securely engages with concave portion 3A of access key 3.

The locking means preferably also comprises a second position locking means for locking first member 4 in the second position so that an access key 3 is locked within housing member 1 while key ring K is released therefrom. The second position locking means preferably comprises first member 4 having detent 9 disposed along the bottom surface thereof, such as between prongs 11 as shown in FIG. 1; and wedge member 8 which is disposed within housing member 1, such as along an inner, bottom surface thereof, so that detent 9 and wedge member 8 form a snap-lock engagement when in contact with each other.

In this regard, housing member 1 preferably includes a pair of slots 22 defined longitudinally through the bottom surface thereof, as shown in FIG. 1. Slots 22 are preferably defined along either side of wedge member 8 so that wedge member 8 may act as a spring in resiliently returning to its position at rest after being temporarily downwardly displaced. In this way, detent 9 of first member 4 temporarily urges wedge member 8 downwardly away from first member 4 by contacting inclined surface 8A as first member 4 translates from the first position to the second position, at which point detent 9 is moved past wedge member 8, as shown in FIG. 6. No longer being urged downwardly and away from first member 4, resilient wedge member 8 moves back to its position at rest, wherein vertical surface 8B is now adjacent detent 9 of first member 4. At this point, first member 4 cannot move back towards the first position due to wedge member 8 being in the path of detent 9. As a result, first member 4 is locked in the second position.

The second position locking means is deactivated by movement of wedge member 8 away from first member 4 so that wedge member 8 no longer prevents movement thereof. Movement of wedge member 8 may be accomplished by engaging key ring K with tab 21 of wedge member 8 and pulling key ring K sufficiently downwardly so that detent 9 of first member 4 no longer contacts wedge member 8, as shown in FIG. 7. When detent 9 no longer contacts wedge member 8, first member 4 preferably automatically moves from the second position to the first position due to coil spring 15 (FIG. 2) presenting an axial force on first member 4. When in the first position, key ring K is retained by first member 4 and housing member 1, first member 4 is locked in place by the engagement between prongs 11 and detents 17, and second member 5 is engaged along an upper portion of slots 7 so that flange 23 is lifted from cavity 3A of access key 3, thereby releasing its engagement with access key 3, as shown in FIG. 2.

Referring to FIG. 1, housing member 1 preferably but not necessarily includes one or more sets of wing members 30 which extend from housing member 1 proximally to tab 21 of housing member 1 in order to discourage unlocking of the locking means using devices other than key rings K.

The present invention preferably includes a means for indicating the status of a key ring K which has been previously removed. The status indicating means preferably comprises tag 35 which is slidably associated with window 36 of mounting plate 2, as shown in FIG. 1. Tag 35 preferably includes a tab member 35C which separates tag 35 into a first face 35A and second face 35B. Tag 35 is preferably slidable relative to mounting plate 2 such that either tag face 35A or tag face 35B is viewable through window 36. Tab 35C may be used to position tag 35 relative to mounting plate 2 so that the desired face 35A or 35B is visible. By having markings on faces 35A and 35B and by moving tab 35 with tab 35C, a user who removes a key ring K from housing member 1 may indicate to other users whether the removed key ring has been either permanently or temporarily removed from housing member 1.

The present invention preferably but not necessarily includes a universal key with which an access key 3 may be released from a housing member 1 without having to retain a key ring K. As shown in FIG. 9, master key 40 preferably comprises a handle portion 40C and an arm 40A which extends therefrom. Arm 40A is preferably but not necessarily substantially semi-circular and includes a protrusion 40B disposed at its outermost end. The size and shape of arm 40A preferably allows universal key 40 to engage with tab 21 of housing member 1 by protrusion 40B catching onto tab 21, so that pulling universal key 40 sufficiently downwardly urges tab 21 downwardly, until wedge member 8 is disengaged from detent 9 of first member 4. When wedge member 8 is disengaged from detent 9, first member 4 and second member 5 are translatable to the first position at which access key 3 is discharged from housing member 1. Because of the semi-circular shape of arm 40A, universal key 40 is not locked against housing member 1 when the locking means is in the second position. As a result, both universal key 40 and the retained access key 3 may be removed from housing member 1.

In a second preferred embodiment of the present invention, a plurality of housing members 1 are secured to a backplane 25 (FIG. 8) in order to allow for the management of a plurality of key rings K. In this second embodiment, each access key 3 is preferably selectively operable with each housing member 1.

Backplane 25 may be portable by attachment to one or more wheels, as shown in FIG. 8. Alternatively, backplane 25 may be attached to brackets so that backplane 25 is mountable along a wall or pole.

In use, in a locked configuration thereof, the locking means of the present invention is in the first position in which a key ring K is suspended by flanges 10 of first member 4 and tab 21 of housing member 1, first member 4 is locked into place due to engagement between prongs 11 and detents 17 of housing member 1, and second member 5 is positioned along an upper portion of slots 7, as shown in FIG. 2. To release key ring K from housing member 1, any one of access keys 3 is inserted into channel 1A in the open end of housing member 1 so that prongs 3C of access key 3 urge prongs 11 of first member 4 temporarily upwardly towards first member 4 until prongs 11 become disengaged and unlocked from detents 17 of housing member 1 (FIG. 5). First member 4 and second member 5 are then freely translated by further insertion of access key 3 within housing member 1 so that wedge member 8 is temporarily downwardly displaced by contact with detent 9 of first member 4 and flange 23 is inserted within concave portion 3A of access key 3.

Continued insertion of access key 3 within housing member 1 causes the locking means of the present invention to enter the second position in which detent 9 of first member 4 is passed substantially completely over wedge member 8 so that wedge member 8 returns to its position at rest and thereby prevents first member 4 from further translation, as shown in FIG. 6. In this second position, second member 5 is positioned along a lower portion of slots 7 of housing member 1 (FIG. 3) so that flange 23 of second member 5 is fixed within cavity portion 3A of access key 3, thereby locking access key 3 within housing member 1. Once detent 9 of first member 4 completely passes over wedge member 8, flanges 10 of first member 4 are sufficiently displaced from tab 21 of housing member 1 so that key ring K is removable therefrom. In the second position, coil spring 15 provides a continual force on first member 4 against wedge member 8.

Key ring K is returned to housing member 1 and access key 3 is released therefrom by first suspending key ring K from tab 21 of wedge member 8 and pulling key ring K downwardly (FIG. 7). The downward movement of tab 21 moves wedge member 8 downwardly until wedge member 8 disengages with detent 9 of first member 4, which then allows first member 4 to translate towards the open end of housing member 1 due to bias forces acting on first member 4 from coil spring 15. The translation of first member 4 causes flanges 10 of first member 4 to engage with key ring K so as to secure it against housing member 1. In addition, the translation of first member 4 towards the open end of housing member 1 translates second member 5 towards the upper portion of slots 7, thereby raising flange 23 from cavity portion 3A of access key 3 so that access key 3 is discharged from housing member 1. When first member 4 is sufficiently translated towards the open end of housing member 1, prongs 11 of first member 4 engage with detents 17 of housing member 1 (FIG. 4), which-locks first member 4 into place within housing member 1. In this first position, key ring K is retained by the present invention and access key 3 is removable therefrom.

Although there have been described what are at present considered to be the preferred embodiments of the present invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims rather than the foregoing description.

We claim:

1. A key management device for use with a key ring, said device comprising:

an access key;

a hollow housing member;

means for locking a key ring to said housing member and releasing said access key when said locking means is in a first position, and for locking said access key to said housing member and releasing said key ring when said locking means is in a second position;

said locking means comprising:

a first member which is adapted to be movable between said first position in which the key ring is lockable to said housing by said first member and said second position in which the key ring is unlockable therefrom, and a second member which is connected to said first member, wherein when said locking means is in said first position said second member releases said access key from said housing, and when said locking means is in said second position said second member locks said access key to said housing;

and further wherein said access key is slidingly received by said housing member and engages with said first member such that insertion of said access key within said housing moves said locking means from said fist position to said second position, without requiring turning movement of said access key.

2. A device as recited in claim 1, wherein:

said housing member has a first end and a second end having an opening formed therein, said housing member further has an internal channel formed therein which communicates with said opening in said second end for receiving said access key therein;

said first member is reciprocally translatable in said channel of said housing between said first position and said second position substantially along a first axial direction; and said locking means includes means for preventing movement of said first member along said first axial direction when said locking means is in said second position, and for restoring movement of said first member along said first axial direction.

3. A device as recited in claim 1, wherein:

said first member forms a snap lock engagement with said housing when said locking means is in said second position.

4. A device as recited in claim 1, wherein:

said first member includes a detent; and said housing member includes a resilient wedge member which is disposed within said housing member such that said detent of said first member engages, with said wedge member when said locking means is in said second position.

5. A device as recited in claim 1, wherein:

said first member moves between said first position and said second position along a first direction;

said second member is translatable in said first direction in accordance with movement by said first member, and in a second direction to engage and disengage said access key.

6. A device as recited in claim 1, wherein:

said second member is translatable along a first axial direction which is offset from a horizontal axis.

7. A device as recited in claim 6, wherein:

said second member includes a flange member which engages with said access key when said second member is positioned along a first portion of said first axial direction and disengages said access key when said second member is positioned along a second portion of said first axial direction.

8. A device as recited in claim 5, wherein:

said second member is slidingly engaged with said first member.

9. A device as recited in claim 2, wherein:

said movement preventing and restoring means restores movement of said first member along said first axial direction via movement of a portion of said housing member in a direction which is different from said first axial direction.

10. A device as recited in claim 1, wherein said housing member has a longitudinal axis, and wherein:

said first and second members are disposed in substantially linear relationship to one another in said housing, along a line which is substantially parallel to said longitudinal axis of said housing member;

said first member is reciprocally translatable between said first position and said second position substantially along a first axial direction which is substantially parallel to said longitudinal axis of said housing member; and said locking means includes means for preventing movement of said first member along said first axial direction when said locking means is in said first position, and for restoring movement of said first member along said first axial direction.

11. A device as recited in claim 10, wherein:

said movement preventing and restoring means comprises said housing member having a detent and said first member having at least one prong member which prevents axial movement of said first member when engaged with said detent of said housing member.

12. A device as recited in claim 11, wherein:

said access key selectively disengages said prong member from said housing detent when said access key is inserted within said housing member.

13. A device as recited in claim 1, wherein:

said device comprises a plurality of housing members, a plurality of access keys, with each of said access keys being suitable for insertion within any of said housing members, and a plurality of said locking means so that each housing member is associated with a separate locking means.

14. A device as recited in claim 13, further including:

a panel member to which each of said housing members is mounted; and said panel member is portable.

15. A device for use with and for retaining one or more key rings, comprising:

at least one housing member;

at least one access key;

locking means for retaining a key ring by said housing member and releasing an access key therefrom when in a first state, and for retaining said access key and releasing the key ring when in a second state;

wherein said locking means is adapted to be movable from said first state to said second state by insertion of said access key within said housing member without requiring turning movement of said access key, and adapted to be movable from said second state to said first state by engagement of the key ring with at least one of said housing member and said locking means; and wherein said locking means includes a resilient portion which is adapted to unlock said locking means from said second state when said resilient portion is temporarily displaced from its position at rest by engagement with the key ring.

16. A device as recited in claim 15, wherein:

said access key includes at least one prong member for unlocking said locking means from said first state when said access key is inserted within said housing member.

17. A device as recited in claim 15, wherein:

said locking means includes a first member which is slidable within said housing member when said locking means is moving between said first state and said second state, and a second member which is connected to said first member and is slidable within said housing member when said locking means is moving between said first state and said second state;

said first member retains the key ring against said housing member when in said first state; and said second member retains said access key within said housing member when in said second state.

18. A device as recited in claim 17, wherein:

said first member is movable within said housing member along a first direction;

said second member is movable within said housing member along a second direction which is different from said first direction;

said second member moves in response to movement by said first member; and said locking means further includes a means for locking said first member to said housing member when said locking means is in said first state, and a means for locking said first member to said housing member when said locking means is in said second state.

19. A device as recited in claim 18, wherein:

said means for locking said first member to said housing member comprises at least one detent member which is associated with one of said housing member and said first member, and a resilient member which engages with said detent member and is associated with the other of said housing member and said first member.

20. A device for using with one or more key rings in controlling key access, comprising:

at least one housing member;

at least one access key;

locking means for retaining a key ring by said housing member and releasing an access key therefrom when in a first state, and for retaining said access key and releasing the key ring when in a second state;

wherein said locking means is adapted to be movable from said first state to said second state by only linear insertion of said access key within said housing member, and adapted to be movable from said second state to said first state by engagement of the key ring with said device;

wherein said locking means includes a first member which is translatable within said housing member when said locking means is moving between said first state and said second state; and a second member which is connected to said first member and is translatable within said housing member when said locking means is moving between said first state and said second state;

wherein said first member is adapted to retain a key ring against said housing member when said locking means is in said first state; and said second member is adapted to retain said access key within said housing member when said locking means is in said second state.

* * * * *